US007703543B2

(12) United States Patent
Waters et al.

(10) Patent No.: US 7,703,543 B2
(45) Date of Patent: Apr. 27, 2010

(54) FIRE FIGHTING FOAM DISPENSING SYSTEM AND RELATED METHOD

(75) Inventors: Dennis L. Waters, Chepachet, RI (US); Robert B. Harriman, Cumberland, RI (US)

(73) Assignee: FM Global Technologies, Johnston, RI (US)

( * ) Notice: Subject to any disclaimer, the term of this patent is extended or adjusted under 35 U.S.C. 154(b) by 1 day.

(21) Appl. No.: 11/907,534

(22) Filed: Oct. 12, 2007

(65) Prior Publication Data

US 2009/0095492 A1 Apr. 16, 2009

(51) Int. Cl.
*A62C 35/00* (2006.01)
*A62C 35/58* (2006.01)
*A62C 37/00* (2006.01)

(52) U.S. Cl. ..... 169/15; 169/13; 169/14; 169/44; 169/56

(58) Field of Classification Search ..... 169/5, 169/13–16, 44, 56, 60, 61
See application file for complete search history.

(56) References Cited

U.S. PATENT DOCUMENTS 3,294,105 A 12/1966 R.F. Schaub
3,817,658 A 6/1974 Murase
4,259,038 A 3/1981 Jorgensen et al.
4,899,825 A 2/1990 Bosoni et al.
5,232,052 A 8/1993 Arvidson et al.
5,240,078 A 8/1993 Worthington
5,398,765 A 3/1995 Worthington
5,494,112 A 2/1996 Arvidson et al.
5,503,533 A 4/1996 Potter et al.
RE35,362 E 10/1996 Arvidson et al.
6,419,454 B1 7/2002 Christiansen
6,454,540 B1 9/2002 Terefinko et al.
6,766,863 B2 7/2004 Arvidson et al.
6,886,639 B2 5/2005 Arvidson et al.
2005/0023006 A1 2/2005 Vonhof et al.
2005/0155776 A1 7/2005 Arvidson et al.

OTHER PUBLICATIONS

International Search Report dated May 8, 2009 from International Application No. PCT/US2008/079516.

*Primary Examiner*—Darren W Gorman
(74) *Attorney, Agent, or Firm*—Venable LLP; Clifton E. McCann; Steven J. Schwarz

(57) ABSTRACT

A fire fighting foam dispensing system includes a water inlet adapted to receive a flow of water, a first variable speed pump adapted to inject foam concentrate into the flow of water, a second variable speed pump adapted to inject foam concentrate into the flow of water, a foam outlet adapted to discharge fire fighting foam, a measuring apparatus adapted to measure flow rate in at least one of the water inlet and the foam outlet, and a system controller adapted to detect the flow rate from the measuring apparatus, and activate the second variable speed pump only upon the measured flow rate exceeding a predetermined flow rate value.

19 Claims, 2 Drawing Sheets

FIRE FIGHTING FOAM DISPENSING SYSTEM AND RELATED METHOD

BACKGROUND

1. Technical Field

This patent application relates generally to a fire fighting system that utilizes foam to suppress fires. More particularly, this patent application relates to a foam dispensing system that precisely mixes a foam concentrate with water to make fire fighting foam. This patent application also relates to methods of precisely mixing the foam concentrate with the water.

2. Related Art

In order to accurately assess the fire suppressing qualities of fire fighting foam, a known quantity of the foam must be applied to a test fire. Typically, this involves applying a precise mixture of water and foam concentrate to the test fire. Some known foam dispensing systems use devices such as venturis, bladders, and diaphragms to control the mixture of foam concentrate and water. However, these known foam dispensing systems often fail to provide adequate precision in the foam concentrate/water mixture, for example, when variations in pressure and/or flow rate occur. Other known foam dispensing systems use a variable speed pump to inject foam concentrate into the water. However, when the variable speed pump reaches the low end or the high end of its speed range (e.g., in response to changes in flow rate), the pump's accuracy decreases, thereby decreasing the precision of the foam concentrate/water mixture. The inaccuracies in the foam concentrate/water ratio of existing dispensing systems often render it difficult to precisely determine the quantity of foam being applied to the fire. This may not provide a significant problem when fighting real life fires, because any inaccuracy in the ratio of foam concentrate to water can be compensated for by applying more foam to the fire than is necessary to extinguish it (although this can result in wasted foam concentrate).

When the foam is being used in a testing environment, however, it is more important for the foam to comprise a precise mixture of foam concentrate and water. Known foam dispensing systems have often proved insufficient for use in testing environments, due to their inability to provide adequate precision in the foam concentrate/water ratio. Therefore, there remains a need in the art for foam dispensing systems and related methods that overcome the shortcomings of the prior art.

SUMMARY

The system and method disclosed in this patent application provide a precise ratio of foam concentrate to water over a wide range of flow values by injecting the foam concentrate into the water using two or more variable speed pumps in an array. By staging the operation of the variable speed pumps (e.g., bringing more pumps online as the demand for foam concentrate increases), each pump can be operated within a speed band where the pump provides a high level of accuracy. This in turn translates into a high level of accuracy with respect to the foam concentrate/water ratio over a wide range of system flows.

According to an exemplary embodiment, a fire fighting foam dispensing system comprises a water inlet adapted to receive a flow of water, a first variable speed pump adapted to inject foam concentrate into the flow of water, a second variable speed pump adapted to inject foam concentrate into the flow of water, a foam outlet adapted to discharge fire fighting foam, a measuring apparatus adapted to measure flow rate in at least one of the water inlet and the foam outlet, and a system controller adapted to detect the flow rate from the measuring apparatus, and activate the second variable speed pump only upon the measured flow rate exceeding a predetermined flow rate value, wherein the predetermined upper threshold speed is less than the pump's maximum possible speed.

According to another exemplary embodiment, a fire fighting foam dispensing system comprises a water inlet adapted to receive a flow of water, a pump array adapted to inject foam concentrate into the flow of water to create fire fighting foam, the pump array comprising at least a first variable speed pump and a second variable speed pump, a foam outlet adapted to discharge the fire fighting foam, a measuring apparatus adapted to measure flow rate in at least one of the water inlet and the foam outlet, and a controller adapted to operate each variable speed pump in the pump array at a speed that is substantially equal to or less than a predetermined upper threshold speed.

According to another exemplary embodiment, a method of producing fire fighting foam comprises activating a first variable speed pump to inject a foam concentrate into a supply of water at a predetermined ratio to form fire fighting foam, measuring flow rate of at least one of the supply of water and the fire fighting foam, and after the measured flow rate exceeds a predetermined flow rate value, activating a second variable speed pump to inject foam concentrate into the supply of water at a predetermined ratio to form fire fighting foam.

Further objectives and advantages, as well as the structure and function of preferred embodiments, will become apparent from a consideration of the description, drawings, and examples.

BRIEF DESCRIPTION OF THE DRAWINGS

The foregoing and other features and advantages of the invention will be apparent from the following drawings wherein like reference numbers generally indicate identical, functionally similar, and/or structurally similar elements.

DETAILED DESCRIPTION

Figure 1:
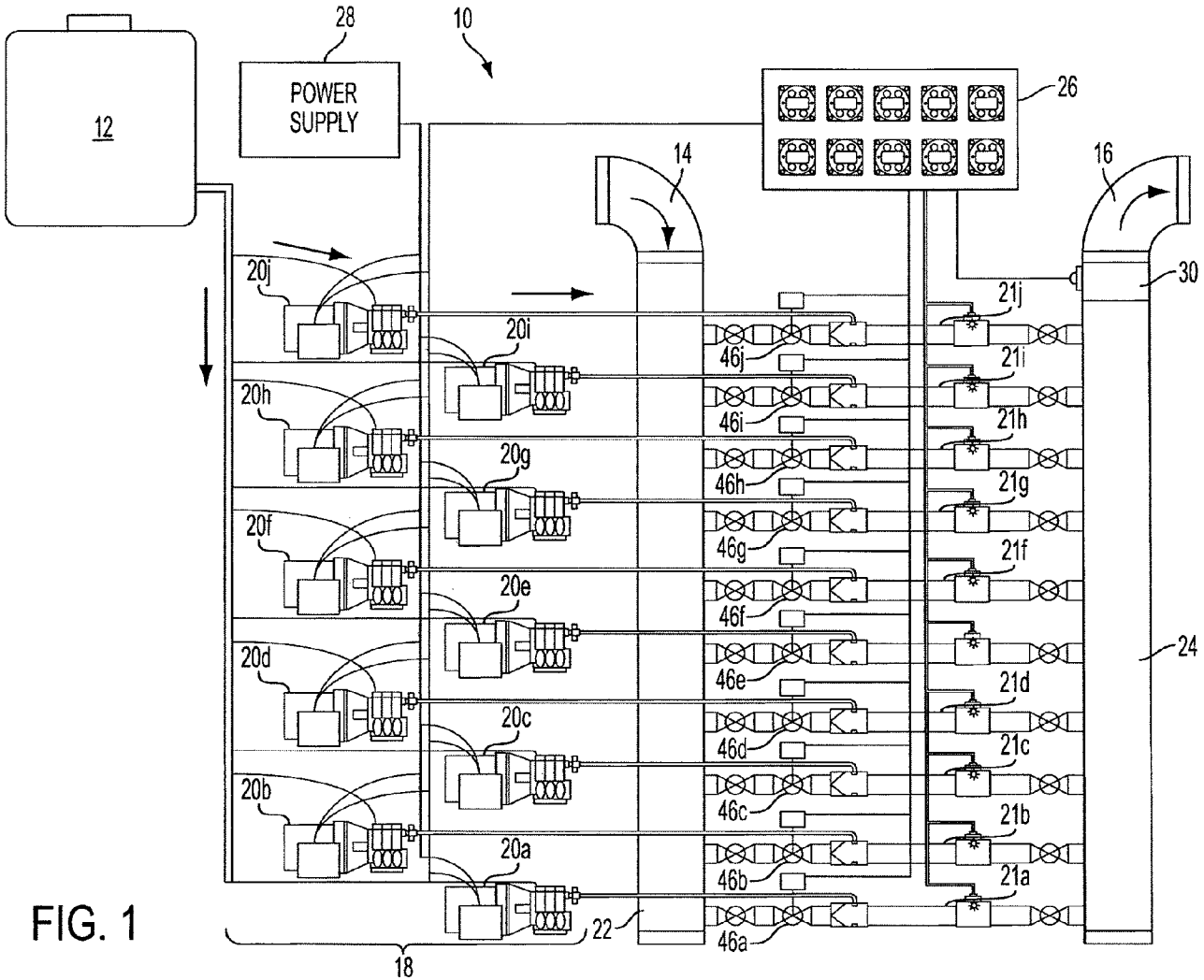
FIG. 1 is a schematic representation of an exemplary fire fighting foam dispensing system according to the present invention.

Referring to FIG. 1, an exemplary fire fighting foam dispensing system 10 is shown schematically. The system 10 is configured to mix fire fighting foam concentrate with water to produce fire fighting foam. The system 10 can also be configured to supply the fire fighting foam to downstream equipment, such as fire hoses, sprinkler systems, testing systems, or other known apparatuses.

The foam concentrate can be stored in a foam tank 12. Although a single foam tank 12 is shown in FIG. 1, the system 10 can alternatively include a plurality of foam tanks, as described in more detail hereafter. The tank(s) 12 can be mounted on a scale, such as a load cell platform, to facilitate calculating the amount of foam concentrate used based on changes in weight. The foam concentrate can comprise Class A foam, Class B foam, Class A/B foam, alcohol resistant-aqueous film forming foam (AR-AFFF), alcohol tolerant concentrate-aqueous film forming foam (ATC-AFFF), high expansion foam, or any other foam concentrate known in the art. The system 10 combines the foam concentrate in the tank 12 with water supplied via a water inlet 14. The water inlet 14 can receive water from various different water supplies, such as a fire hydrant, a building water supply, or other supplies known in the art. Once the water and foam concentrate are combined, the resulting foam is distributed via a foam outlet 16, by which the foam can be supplied to various foam dispensing apparatuses known in the art.

The system 10 includes a pump array depicted generally as 18, which comprises two or more variable speed pumps adapted to inject the foam concentrate into the water, for example, at a point somewhere between the water inlet 14 and the foam outlet 16. In the exemplary embodiment shown, the system comprises an inlet manifold 22 in communication with the water inlet 14, and an outlet manifold 24 in communication with the foam outlet 16. The inlet manifold 22 and outlet manifold 24 can be connected to one another by, for example, a plurality of intermediate conduits 21*a*-21*j*. According to the exemplary embodiment shown, the inlet manifold 22 and outlet manifold 24 are connected to one another only by the intermediate conduits 21*a*-21*j*, however, other configurations are possible. As shown in FIG. 1, conduits 21*a*-21*j* can be arranged in parallel to one other, however other configurations are possible. The pump array 18 can inject the foam concentrate into the water between the inlet manifold 22 and the outlet manifold 24, for example, by injecting the foam concentrate into one or more of the conduits 21*a*-21*j*. However, other arrangements and locations are possible for injecting the foam concentrate into the water.

In the exemplary embodiment shown, the pump array 18 comprises ten variable speed pumps 20*a*-20*j*, each of which injects foam concentrate into a respective conduit 21*a*-21*j*. However, other arrangements are possible. For example, the array 18 can alternatively comprise more or less than ten pumps, and/or the pumps can introduce the foam concentrate into the water at locations other than the conduits. According to an exemplary embodiment, the variable speed pumps 20*a*-20*j* are 24 volt DC electric pumps with and auto-on feature manufactured by FoamPro under model number S206-2002, however a variety of variable speed pumps known in the art can alternatively be used.

Still referring to FIG. 1, the system 10 can further include a system controller 26 in communication with, among other things, the pumps 20*a*-20*j*. The system 10 can also include a power supply 28 adapted to provide power to, among other things, the pumps 20*a*-20*j*. A flow meter 30 can be provided to measure the total fluid flow through the system. The flow meter 30 can measure the flow proximate the outlet manifold 24 or foam outlet 16, as shown in FIG. 1. Alternatively or additionally, the flow meter 30 can measure the flow proximate the water inlet 14 or the inlet manifold 22. According to an exemplary embodiment, the flow meter 30 is an ultrasonic unit manufactured by General Electric Panametrics, Model No. PT 878, although a variety of flow meters known in the art, including paddle-wheel flow meters, can alternatively be used. The flow meter 30 can transmit the flow data to the system controller 26.

Figure 2:
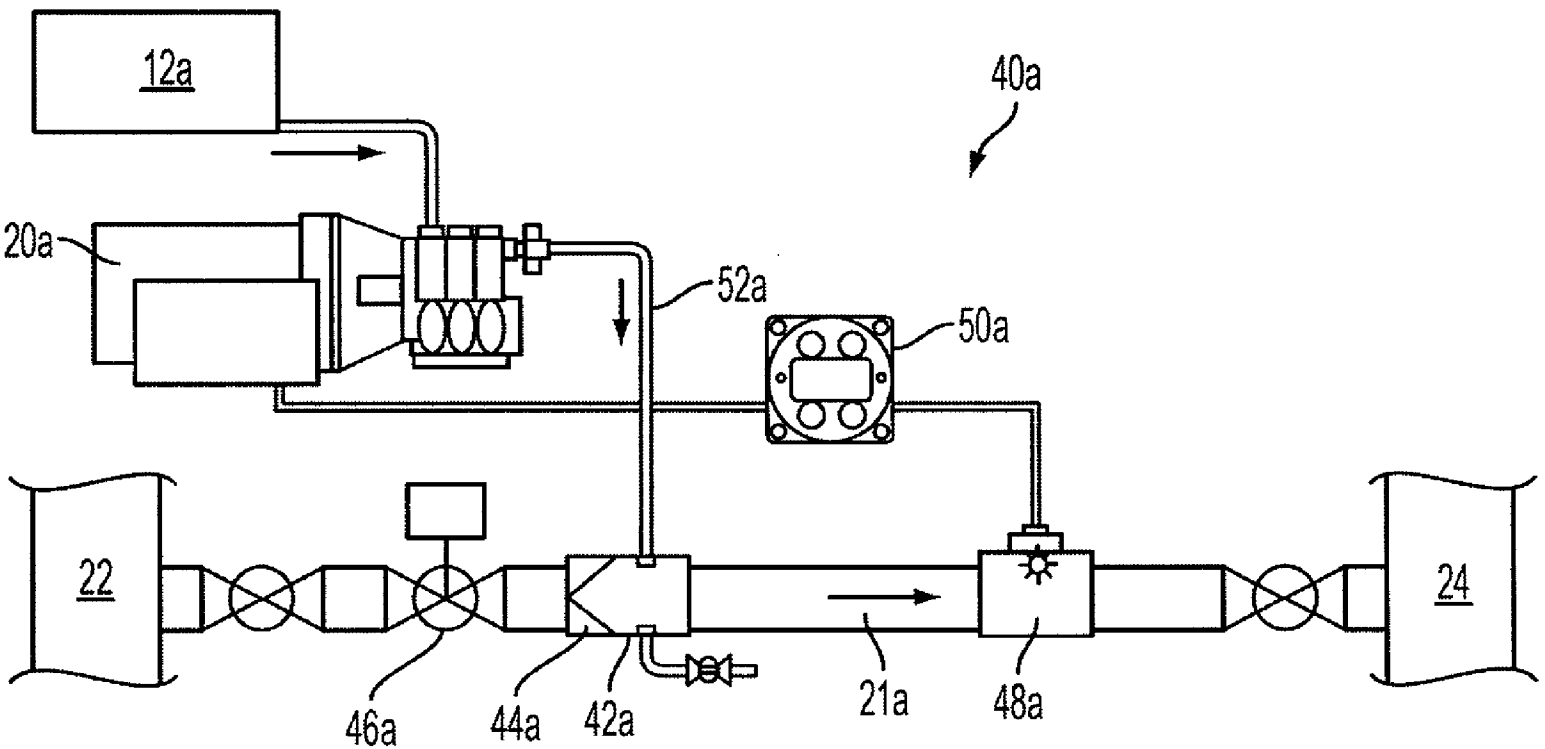
FIG. 2 is an enlarged, schematic representation of an exemplary pump subsystem of the foam dispensing system of FIG. 1.

Each variable speed pump 20*a*-20*j* within the array 18 can form part of a pump subsystem. FIG. 2 depicts an exemplary pump subsystem 40*a* including variable speed pump 20*a* (note that FIG. 2 and the related description can apply equally to the other pump subsystems in the array 18). As shown in FIG. 2, the variable speed pump 20*a* can receive foam concentrate from a foam tank 12*a*. In the schematic representation of FIG. 1, a single foam tank 12 is shown supplying foam concentrate to all of the pumps 20*a*-20*j* in the array, however, an individual foam tank 12*a* can alternatively be provided for each pump, as shown in FIG. 2. Pump 20*a* withdraws foam concentrate from the tank 12*a*, pressurizes the foam concentrate, and then injects it into the conduit 21*a*, for example, through a foam injection port 42*a*. Conduit 21*a* can include a check valve 44*a*, located upstream from the foam injection port 42*a*, that substantially prevents water, foam concentrate, and/or foam from flowing backwards through the system (i.e., upstream) towards the inlet manifold 22.

Still referring to FIG. 2, a valve 46*a* can be provided in the conduit 21*a* to selectively allow or disallow water flow through the conduit 21*a* between the inlet manifold 22 and the outlet manifold 24. The valve 46*a* can be controlled remotely, for example, by the system controller 26 (shown in FIG. 1), as will be described in more detail below. The valve 46*a* can comprise, for example, a pneumatic ball valve, although other known types of valves can be used as alternatives, such as a pneumatically or electrically actuated butterfly valve, an electrically actuated solenoid valve, or an electric/hydraulic actuated globe valve.

A flow meter 48*a*, such as a paddle wheel flow meter, can be located in conduit 21*a* to measure the total fluid flow through conduit 21*a*. Flow meter 48*a* can comprise a turbine flow meter, or a magnetic flow meter, although other types of flow meters known in the art can alternatively be used. Subsystem 40*a* can further include a pump controller 50*a* that can turn variable speed pump 20*a* on or of, and can also control the speed of pump 20*a*. The pump controller 50*a* can comprise, for example, a Programmable Logic Controller (PLC), an Advanced Digital Feature Controller (ADFC), such as manufactured by FoamPro, or other type of controller known in the art. Pump 20*a* can provide data regarding its rotation rate (i.e., speed) back to its respective pump controller 50*a*. The pump controller 50*a* can be in communication with the flow meter 48*a*, such that the fluid flow rate through conduit 21*a* is transmitted from flow meter 48*a* to pump controller 50*a*.

The system controller 26 can open or close each of the conduits 21*a*-21*j*, for example, using the respective valve 46*a*-46*j* associated with the conduit. For example, as the total flow through the system increases beyond certain predetermined flow levels, the system controller 26 can open one or more additional valves 46*a*-46*j*, thereby bringing online additional conduits 21*a*-21*j* and the associated pump subsystems. Alternatively, as the total flow through the system decreases below certain predetermined flow levels, the system controller 26 can close one or more of the open valves 46*a*-46*j*, thereby shutting down the respective conduit 21*a*-21*j* and associated pump subsystem. As will be described in more detail hereinafter, this system of opening and closing the conduits in response to changes in demand on the pump subsystem(s) can provide a high level of accuracy in the foam concentrate to water ratio over a wide range of system flow rates.

Each pump subsystem, when activated, can operate to supply a precise mixture of foam concentrate/water to the outlet manifold 24. The desired ratio of foam concentrate to water (selected by the operator) can be input into the pump controller 50*a*. For example, the desired ratio can be input by the operator directly at the pump controller 50*a*. Alternatively or additionally, the desired ratio can be set at the system controller 26, and then communicated from the system controller 26 to each of the pump controllers 50*a*.

Still referring to FIG. 2, when operating, each subsystem can operate as follows. The flow meter 21*a* measures the total flow rate through the conduit 21*a*, and communicates that flow rate to the pump controller 50*a*. Based on the measured flow rate and the set water/concentrate ratio, the pump controller 50*a* determines the amount of foam concentrate that needs to be injected into the conduit 21*a* in order to maintain the set ratio. The pump controller 50*a* then instructs the variable speed pump 20*a* to pump the necessary amount of foam concentrate into the conduit 21*a* (e.g., via hose 52*a*). For example, the pump controller 50*a* adjusts the operating speed of the variable speed pump 20*a*. The pump controller 50*a* continuously monitors the flow rate in the conduit 21*a*, based on the data from the flow meter 21*a*, and adjusts the speed of the variable speed pump 20*a* to maintain the desired water/concentrate ratio. Therefore, each subsystem can monitor the total flow rate through its conduit, e.g., conduit 21*a*, and inject the appropriate amount of foam concentrate into that conduit to maintain the set ratio of water/concentrate through that conduit.

Typically, variable speed pumps provide their highest level of accuracy (e.g., with respect to speed or flow rate) when operating within a specific speed range that is somewhere between the pump's minimum speed (i.e., off) and the pump's maximum speed. The specific speed range, sometimes referred to herein as the pump's "optimum speed band," can be defined on the lower end by a lower threshold speed that is somewhere above zero revolutions per minute (RPMs). On the upper end the optimum speed band can be defined by an upper threshold speed somewhere below the maximum operating speed of the pump. The accuracy of the pump typically drops significantly when the pump speed falls outside of the optimum speed band. In order for the foam dispensing system 10 described herein to operate at a high level of precision, the system 10 can be adapted to operate each of the variable speed pumps 20*a*-20*j* in the array 18 within its optimum speed band. One of ordinary skill in the art will understand that the "optimum speed band" can vary depending on the type and specifications of the specific pumps being used in the system, and therefore, the upper threshold speed and lower threshold speed will vary depending on the specific pumps used in the system. The optimum speed band for a given pump can be determined hypothetically, for example, based on the specifications for a given pump, or empirically, for example, by testing a pump's accuracy over its entire operating speed range. As used herein, the term "optimum speed band" of the pumps can refer to the absolute value, of the pump's speed (i.e., its RPM), or alternatively, can refer to some indirect measurement that is reflective of the pump's speed, for example, the fluid flow output rate of the pump.

Referring to FIG. 1, the system controller 26 can monitor the total flow through system 10, for example, via the flow meter 30 located in the outlet manifold 24. Based on the total system flow, or other factors described hereinafter, the system controller 26 can determine how many pumps in the array 18 are needed in order for each pump to operate within its optimum speed band. The system controller 26 can then turn on the necessary amount of pumps in the array 18, for example, by opening the valve 46 in the respective conduit 21, thereby allowing fluid to flow through the conduit 21 from the inlet manifold 22 to the outlet manifold 24. Once the valve 46 in a respective conduit, for example, conduit 21*a*, is opened, the pump controller 50*a* and flow meter 21*a* associated with that conduit 21*a* work in unison to maintain the desired ratio of concentrate to water in that conduit, as discussed previously. In the event that the total system flow (as measured, e.g., by flow meter 30) increases or decreases to the extent that additional or fewer pumps are needed in order for each of the operating pumps to stay within their optimum speed band, the system controller 26 can bring additional pumps online by opening the valve 46 associated with a respective conduit 21, or alternatively, can shut pumps off by closing a valve 46 associated with a respective conduit 21. As discussed above, once a particular valve 46 is open and fluid is flowing through the respective conduit 21, the respective pump controller 50, flow meter 21, and variable speed pump 20 of the subsystem operate in unison to maintain the desired concentrate/water ratio in that conduit 21. According to an alternative embodiment, the system controller 26 (in addition to, or instead of the pump controller) can operate to maintain the desired concentrate/water ratio in each conduit 21.

One of ordinary skill in the art will appreciate based on this disclosure that the system 10 is not limited to activating or deactivating the pumps in the array 18 based on the total flow rate of the system. That is, other variables may alternatively or additionally be used to determine appropriate tripping points for activating or deactivating pumps within the array 18. For example, the flow rate within each of the conduits 21*a*-21*j* (or other locations) can be measured and analyzed to determine whether pumps within the array need to be activated or deactivated. Alternatively or additionally, the speed or flow rate of each active pump within the array can be monitored to determine if any of the active pumps are outside of its optimum speed band, at which point pumps can be activated or deactivated as needed. One of ordinary skill in the art will appreciate based on this disclosure that other criteria for activating and deactivating pumps within the array 18 are also possible for the system 10.

Exemplary Operation

The operation of an exemplary embodiment of the system 10 shown in FIGS. 1 and 2 will now be described in connection with the following example.

A fire fighting foam dispensing system was constructed in accordance with FIGS. 1 and 2. Two elevated 300 gallon totes were piped together to serve as the foam tank 12, which supplied the variable speed pumps 20*a*-20*j* via a gravity feed. The water inlet 14 was connected to a private water supply. The foam outlet 16 was connected to a network of overhead sprinklers in a fire testing and evaluation laboratory. The pump controllers 50*a*-50*j* were each set to inject a 1% ratio of foam concentrate into the water supply (i.e., 1 part foam concentrate per 100 parts water). The system controller 26 was set at a trigger point of 400 gallons per minute (GPM) for activating/deactivating pumps within the array 18. The trigger point of 400 GPM was determined based on the optimum speed band of the variable speed pumps 20*a*-20*j* used, which were the HYDRO Power Line Plus Model 2345B-P-8, and may be different for other types, sizes, etc., of pumps.

The system 10 was activated with the first valve 46*a* in the open position, allowing fluid flow between the inlet manifold 22 and the outlet manifold 24 through the first conduit 21*a*. The remaining valves 46*b*-*j* and associated conduits 21-*j* were in the closed position upon startup. A test fire was started, which caused the sprinklers to open.

Upon initial opening of the sprinklers, water began flowing through the first conduit 21*a*, and the first variable speed pump 20*a* injected the foam concentrate into the conduit 21*a* in the selected 1% ratio under the control of pump controller 50*a*. Once the flow meter 30 detected a total system flow of 400 GPM (also corresponding to a flow of 400 GPM through the first conduit 21*a*), the system controller 26 opened the valve 46*b* in second conduit 21*b*. The resulting fluid flow through second conduit 21*b* in turn caused the second variable speed pump 20*b* to inject the foam concentrate into the second conduit 21*b* in the selected 1% ratio, under the control of second pump controller 50*b*. With fluid flowing through the first conduit 21*a* and the second conduit 21*b*, the flow rate through each conduit was reduced by half (e.g., to 200 GPM each). As the total system flow continued to increase (e.g., as more sprinklers in the sprinkler network opened), and reached 800 GPM, the system controller opened the valve 46*c* in third conduit 21*c*. The resulting fluid flow through the third conduit 21*c* caused the third variable speed pump 20*c* to inject foam concentrate into the third conduit 21*c* in the selected 1% ratio, under the control of third pump controller 50*c*. This operational trend continued as the total system flow increased, with additional valves 46 and associated conduits 21 being opened as total flow increased in intervals of 400 GPM, until all ten conduits 21*a*-21*j* were open and all ten variable speed pumps 20*a*-20*j* were operating. In the event of a significant decrease in the total system flow, for example, from 1,000 GPM to 600 GPM, the system controller 26 would close one of the valves, for example, valve 46*c*, reducing the system to two conduits 21*a* and 21*b*, both flowing at about 300 GPM. By deactivating conduits and pump subsystems in response to decreases in total system flow, the system 10 can ensure that the pumps in the array not only operate below their upper threshold speed, but also operate above their lower threshold speed. The exemplary system with ten variable speed pumps 20*a*-20*f* provided a precise 1% foam concentration across a broad range of flows up to 4,000 GPM. The total capacity of the system 10 can be increased or decreased, for example, by adding or removing variable speed pumps from the array 18. While the exemplary system used in the example was operated at a 1% foam concentration, it can alternatively be operated at other foam concentrations, for example, anywhere from 0.1% to 5.0%.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A fire fighting foam dispensing system, comprising:

a water inlet adapted to receive a flow of water;

a first variable speed pump adapted to inject foam concentrate into the flow of water;

a second variable speed pump adapted to inject foam concentrate into the flow of water;

a foam outlet adapted to discharge fire fighting foam;

a measuring apparatus adapted to measure flow rate in at least one of the water inlet and the foam outlet;

a system controller adapted to detect the flow rate from the measuring apparatus, and activate the second variable speed pump only upon the measured flow rate exceeding a predetermined flow rate value;

a first intermediate conduit in fluid communication with the first variable speed pump, the first intermediate conduit extending between the water inlet and the foam outlet;

a second intermediate conduit in fluid communication with the second variable speed pump, the second intermediate conduit extending between the water inlet and the foam outlet;

a first valve located in the first intermediate conduit; and a second valve located in the second intermediate conduit;

wherein the system controller is adapted to open the second valve only upon the measured flow rate exceeding the predetermined flow rate value.

2. The fire fighting foam dispensing system of claim 1, wherein the water inlet is in fluid communication with the foam outlet solely through the intermediate conduits.

3. The fire fighting foam dispensing system of claim 1, further comprising:

a first pump controller associated with the first variable speed pump, the first pump controller adapted to control the first variable speed pump to inject a predetermined ratio of foam concentrate into the flow of water; and a second pump controller associated with the second variable speed pump, the second pump controller adapted to control the second variable speed pump to inject a predetermined ratio of foam concentrate into the flow of water.

4. The fire fighting foam dispensing system of claim 1, wherein the measuring apparatus comprises a flow meter in fluid communication with the foam outlet.

5. The fire fighting foam dispensing system of claim 1, wherein the system controller is adapted to operate each variable speed pump at a speed substantially equal to or greater than a predetermined lower threshold speed, wherein the predetermined lower threshold speed is greater than zero.

6. A fire fighting foam dispensing system, comprising:

a water inlet adapted to receive a flow of water;

a first variable speed pump adapted to inject foam concentrate into the flow of water;

a second variable speed pump adapted to inject foam concentrate into the flow of water;

a foam outlet adapted to discharge fire fighting foam;

a measuring apparatus adapted to measure flow rate in at least one of the water inlet and the foam outlet;

a system controller adapted to detect the flow rate from the measuring apparatus, and activate the second variable speed pump only upon the measured flow rate exceeding a predetermined flow rate value;

a first pump controller associated with the first variable speed pump, the first pump controller adapted to control the first variable speed pump to inject a predetermined ratio of foam concentrate into the flow of water;

a second pump controller associated with the second variable speed pump, the second pump controller adapted to control the second variable speed pump to inject a predetermined ratio of foam concentrate into the flow of water;

a first intermediate conduit in fluid communication with the first variable speed pump;

a second intermediate conduit in fluid communication with the second variable speed pump;

a first flow meter measuring fluid flow through the first intermediate conduit and communicating flow data to the first pump controller; and a second flow meter measuring fluid flow through the second intermediate conduit and communicating flow data to the second pump controller.

7. The fire fighting foam dispensing system of claim 6, wherein the first and second variable speed pumps are part of a pump array further comprising at least a third variable speed pump, further wherein the system controller is adapted to activate the third variable speed pump only upon the measured flow rate exceeding twice the predetermined flow rate value.

8. The fire fighting foam dispensing system of claim 7, further comprising a respective pump controller associated with each of the variable speed pumps in the array.

9. The fire fighting foam dispensing system of claim 7, further comprising a respective intermediate conduit in fluid communication with each of the variable speed pumps in the array.

10. The fire fighting foam dispensing system of claim 6, wherein the system controller is adapted to deactivate the second variable speed pump upon the measured flow rate dropping below the predetermined flow rate value.

11. The fire fighting foam dispensing system of claim 6, wherein the system controller receives the flow rate from the measuring apparatus, and operates only the first variable speed pump when the measured flow rate is substantially equal to or less than the predetermined flow rate value.

12. The fire fighting foam dispensing system of claim 6, wherein the system controller operates both the first variable speed pump and the second variable speed pump when the measured flow rate is between one and two times the predetermined flow rate value.

13. The fire fighting foam dispensing system of claim 6, wherein the water inlet is in fluid communication with the foam outlet solely by the intermediate conduits.

14. The fire fighting foam dispensing system of claim 6, wherein each variable speed pump is part of a pump subsystem comprising a flow meter adapted to measure flow through the respective intermediate conduit, and a pump controller adapted to control the speed of the respective variable speed pump.

15. The fire fighting foam dispensing system of claim 14, wherein each pump subsystem is adapted to inject foam concentrate into the flow of water at a predetermined ratio.

16. A method of producing fire fighting foam, comprising:

activating a first variable speed pump to inject a foam concentrate into a supply of water at a predetermined ratio to form fire fighting foam;

measuring flow rate of at least one of the supply of water and the fire fighting foam;

after the measured flow rate exceeds a predetermined flow rate value, activating a second variable speed pump to inject the foam concentrate into the supply of water at a predetermined ratio to form fire fighting foam, wherein the first variable speed pump injects foam concentrate into a first intermediate conduit extending between a water inlet and a foam outlet; and opening a valve in a second intermediate conduit extending between the water inlet and the foam outlet after the measured flow rate exceeds the predetermined flow rate value.

17. The method of claim 16, wherein measuring flow rate of at least one of the supply of water and the fire fighting foam comprises measuring the flow rate proximate a foam outlet.

18. The method of claim 16, further comprising measuring flow rate through the first intermediate conduit, and in response, injecting foam concentrate into the first intermediate conduit at a rate necessary to maintain the predetermined ratio.

19. The method of claim 16, further comprising deactivating the second variable speed pump after the measured flow rate falls below the predetermined flow rate value.

* * * * *